US009936820B2

(12) United States Patent
Sclare et al.

(10) Patent No.: US 9,936,820 B2
(45) Date of Patent: Apr. 10, 2018

(54) NURSING AND INFANT SUPPORT PILLOW

(75) Inventors: Jacob Sclare, Dacula, GA (US); John Matthew Thomson, Johns Creek, GA (US); Cary Costello, Atlanta, GA (US); Peter Jackson, Alpharetta, GA (US)

(73) Assignee: KIDS II, INC., Atlanta, GA (US)

( * ) Notice: Subject to any disclaimer, the term of this patent is extended or adjusted under 35 U.S.C. 154(b) by 567 days.

(21) Appl. No.: 13/243,570

(22) Filed: Sep. 23, 2011

(65) Prior Publication Data

US 2012/0073058 A1 Mar. 29, 2012

Related U.S. Application Data

(60) Provisional application No. 61/386,165, filed on Sep. 24, 2010.

(51) Int. Cl.
*A47C 20/02* (2006.01)
*A47D 13/08* (2006.01)

(52) U.S. Cl.
CPC ..... *A47D 13/083* (2013.01)

(58) Field of Classification Search
CPC ..... A47C 20/02
USPC ..... 5/655, 636, 948–953, 639–640, 657
See application file for complete search history.

(56) References Cited

U.S. PATENT DOCUMENTS

D33,543 S * 11/1900 Hogan ..... D6/604
4,136,685 A 1/1979 Ramey
4,617,691 A * 10/1986 Monti et al. ..... 5/640
5,168,590 A 12/1992 O'Sullivan
5,224,637 A 7/1993 Colombo
5,313,678 A 5/1994 Redewill
5,553,148 A 9/1996 Werle
5,661,861 A 9/1997 Matthews
(Continued)

FOREIGN PATENT DOCUMENTS

CA 2 505 699 10/2006
CN 101448434 6/2009
(Continued)

OTHER PUBLICATIONS

Second Written Opinion of the International Searching Authority dated Sep. 27, 2012, in corresponding International Application No. PCT/US2011/053092.

(Continued)

*Primary Examiner* — Fredrick C Conley
(74) *Attorney, Agent, or Firm* — Gardner Groff Greenwald & Villanueva, PC

(57) ABSTRACT

The present disclosure is directed to the field of juvenile products, specifically infant support or nursing pillows, the intent of which is to support an infant in a variety of settings by providing a stable surface upon which to rest. Various embodiments include a generally crescent shaped device, comprised of a resilient fill material surrounded by a fabric shell and having a top and a bottom surface connected by a band of uniform width extending vertically and wholly about the perimeter of the pillow. The top and bottom surfaces are distinctly different in dimension, resulting in the pillow having an asymmetrical cross section, with one side having generally more loft and the other being substantially flat along a plane perpendicular to the perimeter band. A medial region between two extending arms forms a well, for the purpose of receiving a human torso or small child.

29 Claims, 7 Drawing Sheets

(56) References Cited

U.S. PATENT DOCUMENTS

| | | | | |
|---|---|---|---|---|
| 5,661,862 | A | 9/1997 | Ryndak | |
| 5,664,828 | A * | 9/1997 | Simon | 297/153 |
| 5,682,632 | A | 11/1997 | Cotroneo | |
| 5,754,998 | A * | 5/1998 | Selton | 5/652 |
| 5,790,999 | A | 8/1998 | Clark | |
| 5,813,065 | A | 9/1998 | Tinhorn | |
| 5,971,761 | A | 10/1999 | Tillman, Sr. | |
| 6,026,330 | A * | 2/2000 | Chuang | 607/100 |
| 6,038,720 | A * | 3/2000 | Matthews et al. | 5/639 |
| 6,052,848 | A * | 4/2000 | Kelly | 5/632 |
| 6,070,585 | A * | 6/2000 | Fery et al. | 128/845 |
| 6,175,981 | B1 | 1/2001 | Lizama et al. | |
| D444,981 | S | 7/2001 | Hall et al. | |
| 6,279,185 | B1 * | 8/2001 | Matthews | 5/655 |
| 6,785,921 | B1 | 9/2004 | Conforti | |
| 6,842,925 | B1 | 1/2005 | Owens et al. | |
| D501,349 | S | 2/2005 | Harris et al. | |
| 7,146,663 | B2 | 12/2006 | Brown et al. | |
| 7,322,061 | B2 | 1/2008 | Carrol | |
| D673,410 | S * | 1/2013 | O'Connell | D6/601 |
| 2002/0088058 | A1 | 7/2002 | Matthews Brown | |
| 2004/0025255 | A1 | 2/2004 | Matthews Brown | |
| 2004/0267173 | A1 | 12/2004 | Mangano | |
| 2005/0000023 | A1 | 1/2005 | Brown et al. | |
| 2006/0265809 | A1 | 11/2006 | Wagner | |
| 2007/0022526 | A1 | 2/2007 | Leach | |
| 2007/0192961 | A1 | 8/2007 | Tidwell et al. | |
| 2007/0256242 | A1 * | 11/2007 | Warnock | 5/637 |
| 2012/0131747 | A1 | 5/2012 | Sclare et al. | |

FOREIGN PATENT DOCUMENTS

| | | |
|---|---|---|
| DE | 295 19 799 | 6/1996 |
| GB | 2 316 008 | 2/1998 |
| WO | WO 96/14008 | 5/1996 |
| WO | WO 2010/064809 | 6/2010 |

OTHER PUBLICATIONS

International Search Report and Written Opinion of the International Searching Authority dated Jan. 26, 2011, in corresponding International Application No. PCT/US2011/053092.

International Search Report and Written Opinion of the International Searching Authority dated Mar. 2, 2012, in corresponding International Application No. PCT/US2011/062112.

Written Opinion of the International Preliminary Examining Authority dated Feb. 28, 2013, in corresponding International Application No. PCT/US2011/062112.

Office Action for U.S. Appl. No. 13/303,843 dated May 24, 2013.

Office Action for U.S. Appl. No. 13/836,844 dated May 23, 2013.

U.S. Appl. No. 13/303,843—Final Office Action dated Jan. 2, 2014.

U.S. Appl. No. 13/303,843—Amendment After Final filed Mar. 3, 2014.

U.S. Appl. No. 13/303,843—Advisory Action dated Mar. 14, 2014.

U.S. Appl. No. 13/303,843—Request for Continued Examination and Amendment filed Apr. 2, 2014.

U.S. Appl. No. 13/836,844—RCE and Amendment filed Jan. 22, 2014.

U.S. Appl. No. 13/836,844—Non-final Office Action dated Mar. 12, 2014.

U.S. Appl. No. 14/063,660—Non-final Office Action dated Mar. 26, 2014.

U.S. Appl. No. 13/303,843—Response filed Nov. 13, 2013.

U.S. Appl. No. 13/836,844—Final Office Action dated Oct. 22, 2013.

Search Report for corresponding Chinese Application No. 2011800564865 completed Feb. 13, 2015.

Non-final Office Action for U.S. Appl. No. 13/303,843 dated Feb. 11, 2015.

International Preliminary Report on Patentability for corresponding International Application No. PCT/US2011/062112 dated Aug. 7, 2013.

* cited by examiner

NURSING AND INFANT SUPPORT PILLOW

CROSS-REFERENCE TO RELATED APPLICATION

This application claims priority from U.S. Provisional Patent Application No. 61/386,165, which was filed on Sep. 24, 2010. The disclosure of the referenced application is hereby incorporated herein in its entirety by reference.

FIELD OF THE DISCLOSURE

The present disclosure generally provides infant support pillows having increased utility. In particular, the disclosure provides infant support pillows that can have an asymmetrical cross-section and/or can be alterable in one or more of size and shape.

BACKGROUND

Infant support pillows are differentiated from traditional pillows or support devices in that they are specifically shaped to fit around the torso of a caregiver in order to support an infant while feeding, specifically breast feeding. Alternately, support pillows may serve the purpose of supporting an infant when placed on his tummy, on his back (semi-reclined), or when seated in an upright position.

Known infant support pillows typically are substantially toroidal in shape, with a cross-section that is normally circular or elliptical. Such a configuration generally results in a cross-section that is symmetrical about a laterally extending plane. For example, U.S. Pat. No. 6,279,185 describes a nursing pillow having a medial region with opposing arms, furthermore including a seamless inner section located centrally within the inner well surface. U.S. Pat. No. 5,661,861 discloses a support pillow with opposing arms disposed about an open well at a confronting, touching relationship. Applicants have identified that the disadvantage of these designs is that the versatility of the device is limited, as both support surfaces of the pillow have the same contour.

SUMMARY

In one embodiment a support pillow is provided. The support pillow may comprise a resilient fill material and a fabric shell at least partially enclosing the fill material. The resilient fill material and the fabric shell may define a first arm, a second arm, and a medial region that connects the first arm to the second arm. The first arm, the second arm, and the medial region may partially or substantially surround and define a well, wherein the first arm and the second arm may be configured to be separable to provide a user with access to the well therebetween, or wherein the first arm and second arm may define an opening therebetween to provide access to the well. The first arm, the second arm, and the medial region may define a first laterally-extending support surface with a lofted configuration and an opposing laterally-extending second support surface with a substantially planar configuration.

In some embodiments the support pillow may further comprise a perimeter band, wherein the perimeter band extends around the perimeter, collectively, of the first arm, second arm, and medial region, between the first support surface and the opposing second support surface. The perimeter band may be directly affixed to a first panel of the fabric shell at the first support surface and the perimeter band may be directly affixed to a second panel of the fabric shell at the opposing second support surface. The support pillow may further comprise a seam extending transverse to the perimeter band and proximate to the open well, wherein the seam is configured to prevent tearing of the perimeter band when the first arm and the second arm are pulled apart to increase a width of the opening. A pocket may be defined in the medial region, the first arm, and/or the second arm. The pocket may extend into the medial region at least one of substantially parallel to the opposing second support surface and along a seam extending around the perimeter band. A fabric liner may define the pocket and separate the pocket from the resilient fill material. In other instances, the resilient fill material itself may be configured to define the pocket.

In some embodiments the support pillow may further comprise a selectively-removable cover configured to substantially and collectively enclose the first arm, the second arm, and the medial region. The cover and/or the fabric shell support pillow may comprise a handle, and the handle may define one or more loops configured to attach one or more peripheral components. The cover may define a resealable opening configured to align with a pocket defined in the medial region. The first arm may comprise a first indentation and the second arm may comprise a second indentation, wherein the first indentation and the second indentation are respectively configured to facilitate bending of the first arm and the second arm (i.e., the indentations may form "living hinges" for facilitating bending of the first and second arms).

In some embodiments the support pillow may further comprise an adjustment mechanism configured to adjust at least one of a width of the opening between the first arm and the second arm and an area of the open well. The adjustment mechanism may comprise an elongated flexible member extending from the first arm around the open well to the second arm and a fixation member coupled to one of the first arm and the second arm and configured to releasably engage the elongated flexible member at a user-selectable position. One of the elongated flexible member and the fixation member may comprise a hook material, and the other of the adjustable elongated member and the fixation member may comprise a loop material. The elongated flexible member may define an exposed section disposed at one of the first arm and the second arm and an internal section disposed inside the fabric shell and partially surrounding the open well. The adjustment mechanism may be configured to decrease the area of the open well and the width of the opening between the first arm and the second arm when a length of the exposed section of the elongated flexible member is increased relative to a length of the internal section of the elongated flexible member.

In an additional embodiment a method for forming a support pillow is provided. The method may include providing a resilient fill material and a fabric shell comprising a first panel and a second panel and coupling the first panel of the fabric shell to the second panel of the fabric shell with the fill material therebetween so as to at least partially enclose the fill material with the fabric shell and define a support pillow comprising a first arm, a second arm, and a medial region that connects the first arm to the second arm. The first arm, the second arm, and the medial region may partially or substantially surround and define a well, wherein the first arm and the second arm may be configured to be separable to provide a user with access to the well therebetween, or wherein the first arm and second arm may define an opening therebetween to provide access to the well. The first arm, the second arm, and the medial region may define a first laterally-extending support surface with a lofted configuration and an opposing second laterally-extending support surface with a substantially planar configuration.

In some embodiments the method may further comprise coupling a perimeter band to the first panel of the fabric shell and to the second panel of the fabric shell such that the perimeter band extends around the perimeter of the support pillow between the first support surface and the opposing second support surface. Additionally, the method may include coupling an adjustment mechanism to the support pillow, wherein the adjustment mechanism is configured to adjust at least one of a width of the opening between the first arm and the second arm and an area of the open well. Coupling the adjustment mechanism to the support pillow may comprise enclosing an internal section of an elongated flexible member between the first panel and the second panel of the fabric shell so as to partially surround the open well, and releasably coupling an exposed section of the elongated flexible member to one of the first arm and the second arm.

Other aspects and advantages of the present invention will become apparent from the following.

BRIEF DESCRIPTION OF THE FIGURES

Figure 1:
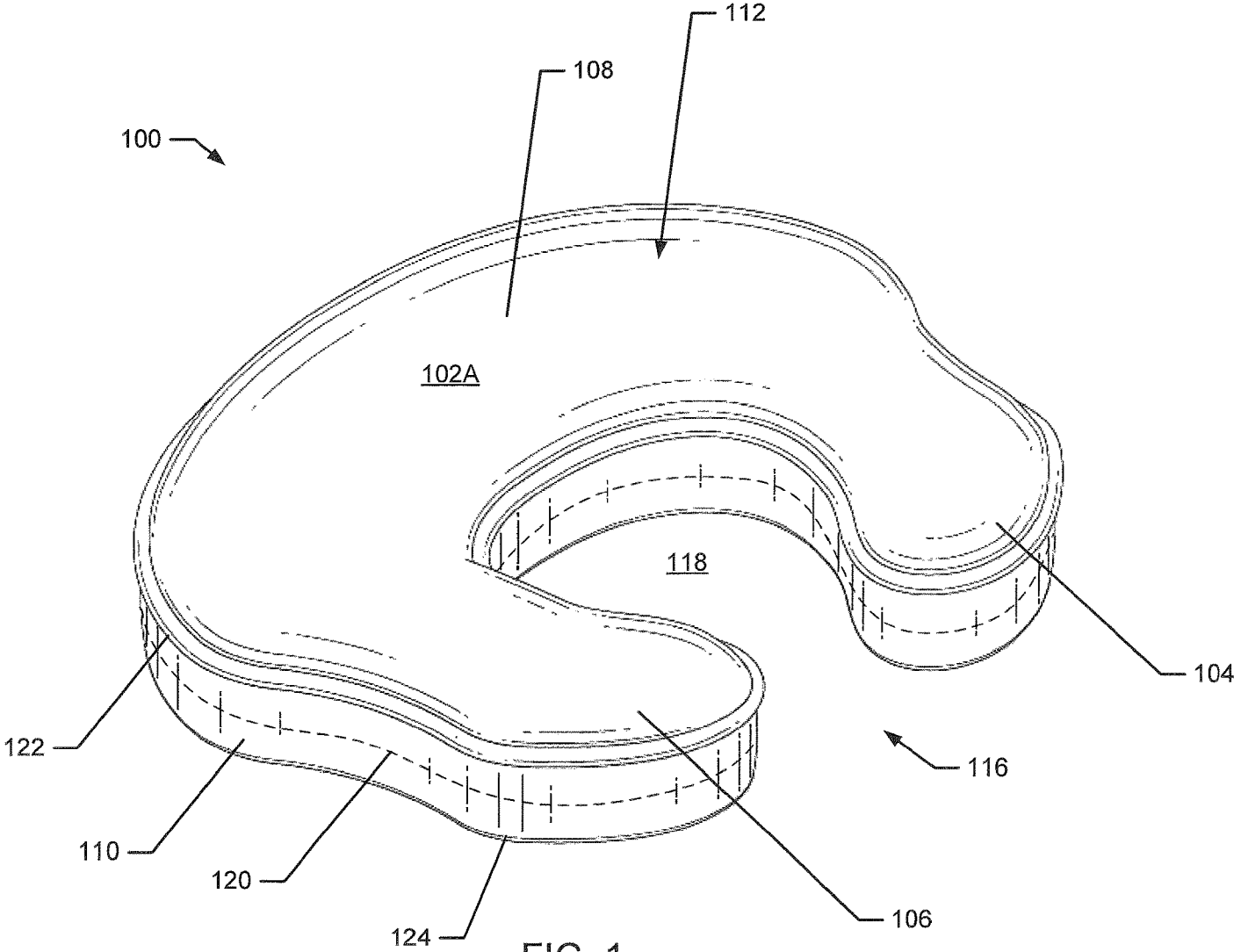
Figure 2:
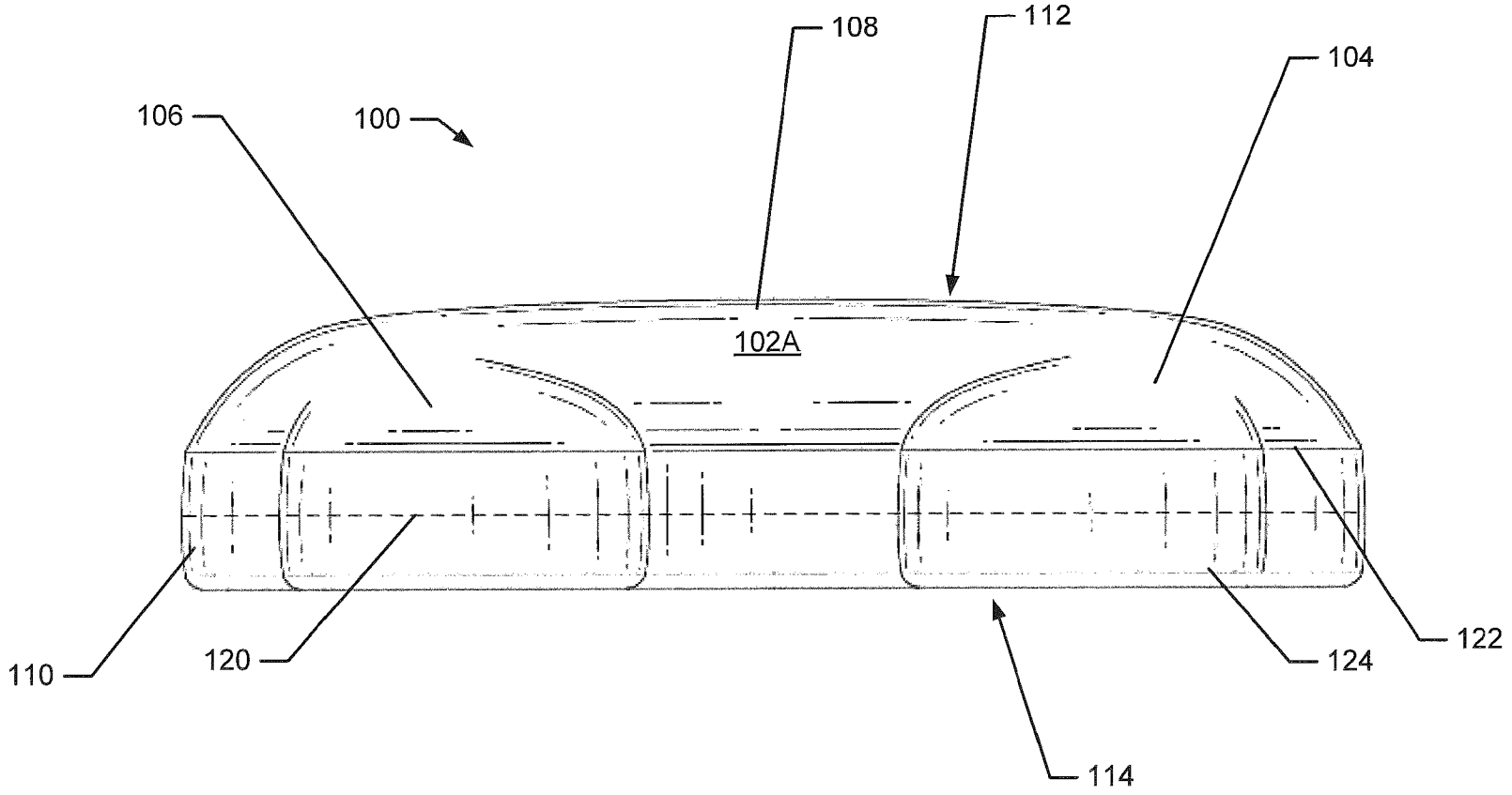
Figure 3:
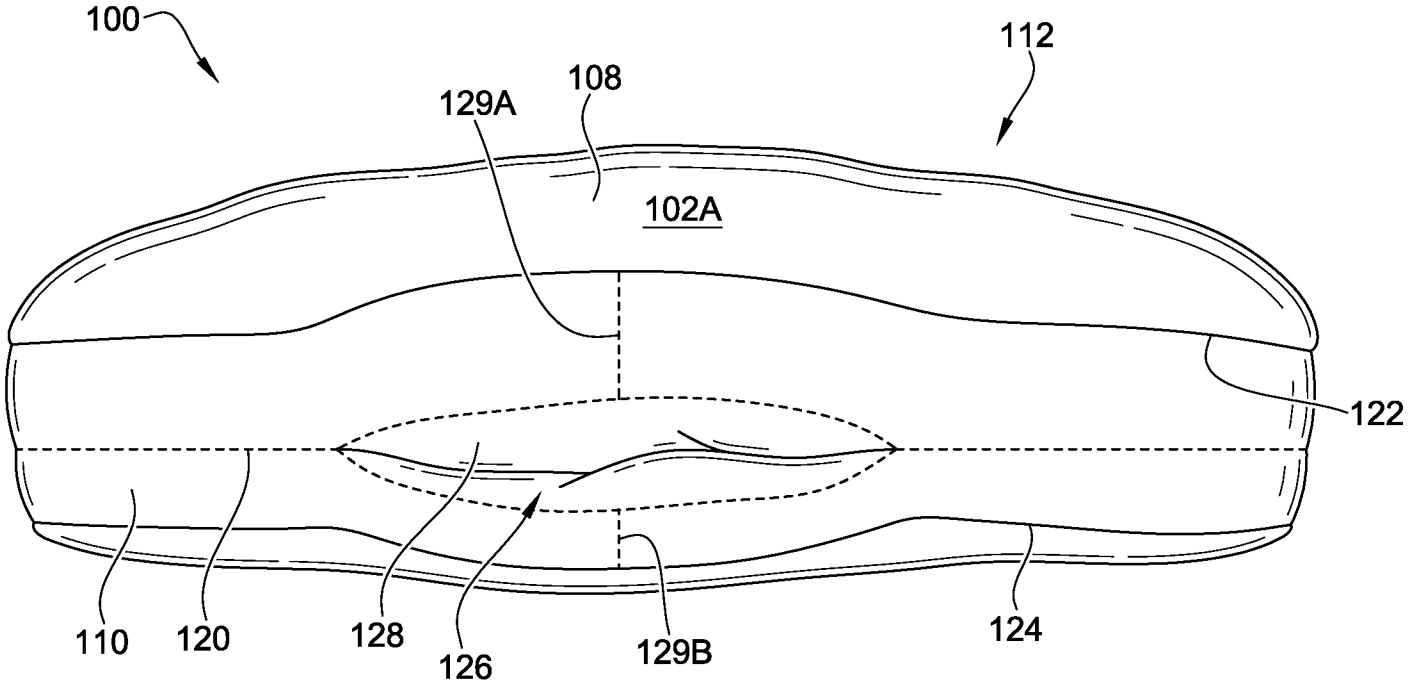
Figure 4:
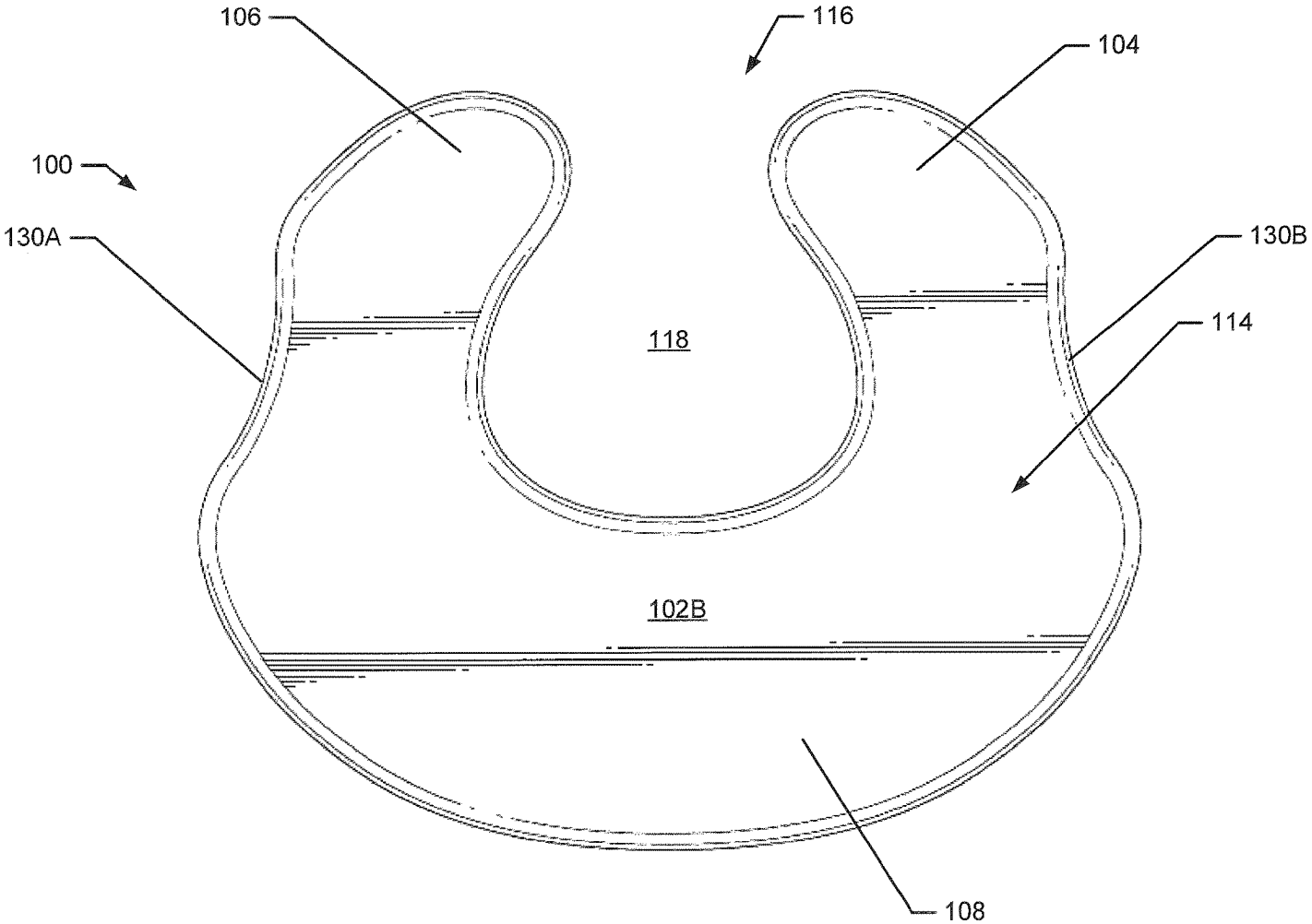
Figure 5:
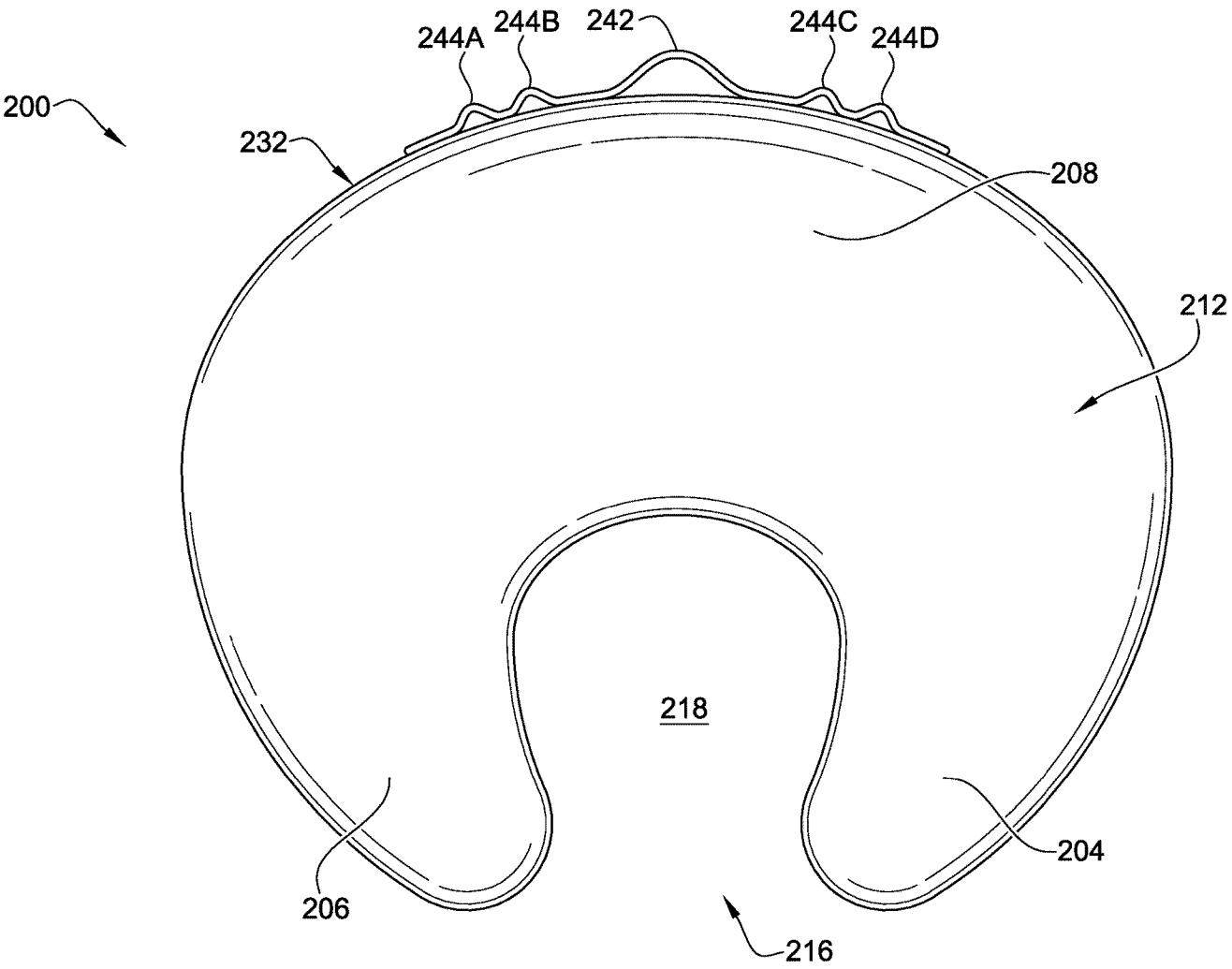
Figure 6:
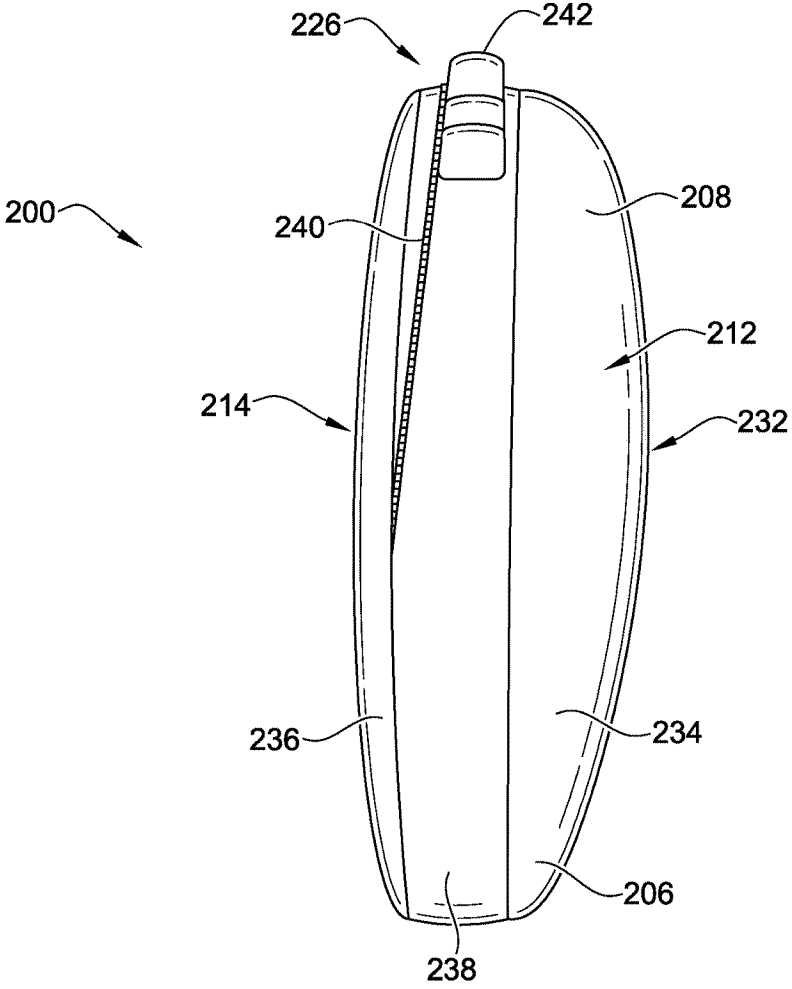

Having thus described the disclosure in general terms, reference will now be made to the accompanying figures, which are not necessarily drawn to scale, and wherein:

FIG. 1 illustrates a perspective view of a support pillow according to a first example embodiment;

FIG. 2 illustrates a front view of the support pillow of FIG. 1;

FIG. 3 illustrates a back view of the support pillow of FIG. 1;

FIG. 4 illustrates a bottom view of the support pillow of FIG. 1;

FIG. 5 illustrates a top view of a support pillow including a cover according to a second example embodiment;

FIG. 6 illustrates a side view of the support pillow of FIG. 5; and

Figure 7:
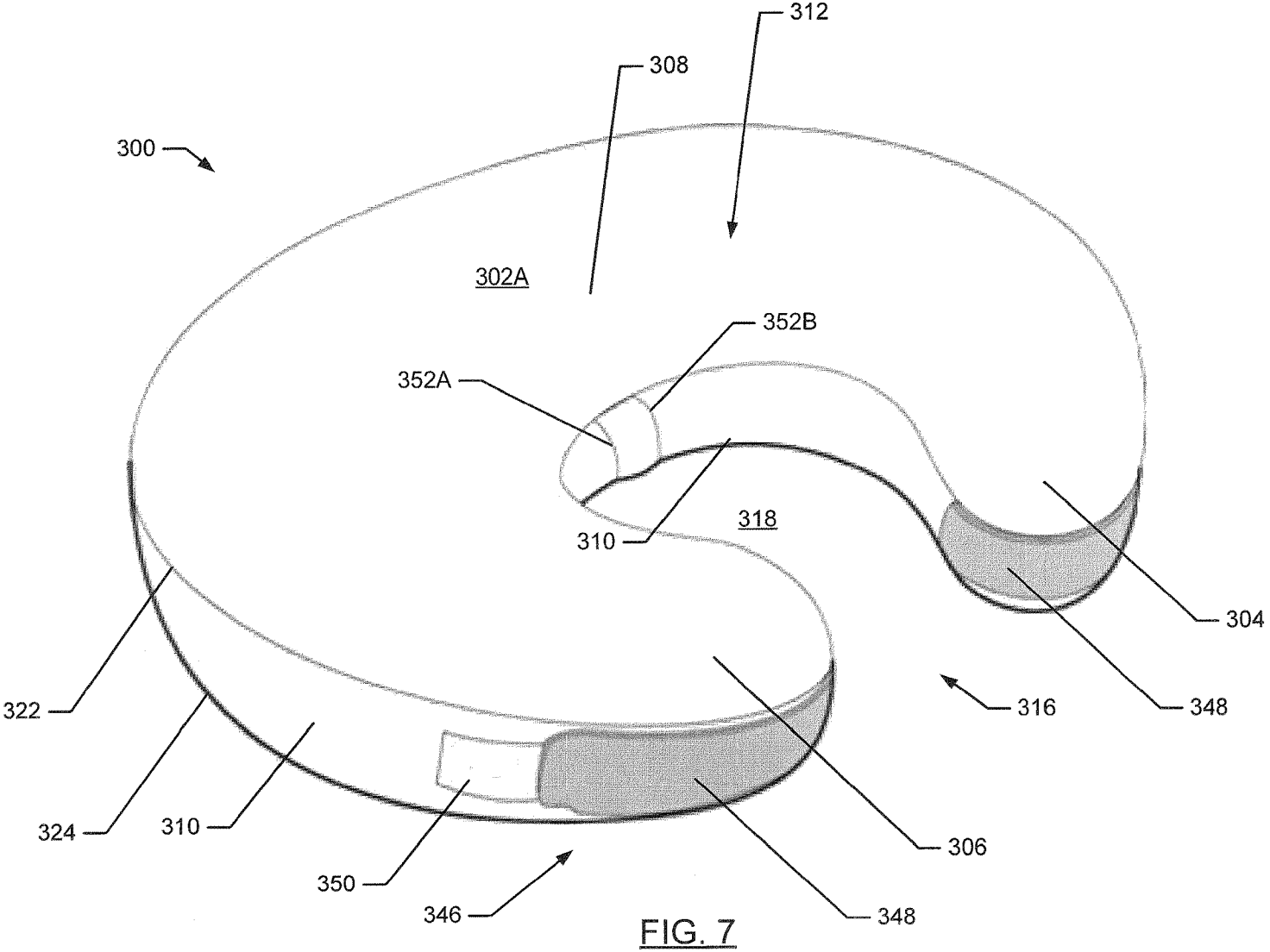

FIG. 7 illustrates a perspective view of a support pillow including an adjustment mechanism according to a third example embodiment.

DETAILED DESCRIPTION OF THE INVENTION

The invention now will be described more fully hereinafter through reference to various embodiments. These embodiments are provided so that this disclosure will be thorough and complete, and will fully convey the scope of the disclosure to those skilled in the art. Indeed, the disclosure may be embodied in many different forms and should not be construed as limited to the embodiments set forth herein; rather, these embodiments are provided so that this disclosure will satisfy applicable legal requirements. As used herein, the singular forms "a", "an", "the", include plural referents unless the context clearly dictates otherwise.

Referring initially to FIG. 1, an embodiment of a support pillow 100 is provided. The support pillow 100 may comprise a fabric shell that may be defined by a first laterally-extending panel 102A (see, e.g., FIG. 1) and a second laterally-extending panel 102B (see, e.g., FIG. 4), and collectively referred to herein as fabric shell 102. The fabric shell 102 may at least partially enclose a resilient fill material. The resilient fill material may comprise one or more layers of polyester batting, foam, loose fill material, and/or various other materials configured to fill the fabric shell 102 and provide structure thereto. The support pillow 100 may comprise a first arm 104, a second arm 106, and a medial region 108 defined at least in part by the fabric shell 102 and the resilient fill material.

In some embodiments the support pillow 100 may further comprise a perimeter band 110 that extends around the perimeter of the support pillow (e.g., extending collectively and continuously around the first arm 104, the second arm 106, and the medial region 108). The perimeter band 110 may comprise fabric or any other material that may provide structure to the support pillow as discussed below. The perimeter band 110 may extend around the perimeter of the support pillow 100 between a first support surface 112 (see, e.g., FIG. 1) and an opposing second support surface 114 (see, e.g., FIG. 4) collectively defined by the first arm 104, the second arm 106, and the medial region 108. The perimeter band 110 may thus be affixed (e.g., directly affixed) to the first laterally-extending panel 102A of the fabric material at the first support surface 112 and affixed (e.g., directly affixed) to the second laterally-extending panel 102B of the fabric material at the opposing second support surface 114.

The first support surface 112 and the opposing second support surface 114 of the support pillow 100 may be configured to support an infant. In one embodiment the support pillow 100 may be configured to be worn by a user when employed to support an infant. In particular, an opening 116 defined between the first arm 104 and the second arm 106 may be configured to provide a user with access to a well 118 at least partially surrounded by the first arm 104, the second arm 106, and the medial region 108. Accordingly, the user may spread the first arm 104 and the second arm 106 so as to allow his or her torso to enter through the opening 116. Normally, the first and second arms 104, 106 may be spaced apart though, in some instances, the first and second arms 104, 106 may be configured to contact each other. In some embodiments a seam 120 may extend around the perimeter band 110 between the first panel 102A and the second panel 102B of the fabric shell 102. The seam 120 may be configured to prevent tearing of the perimeter band 110 when the first arm 104 and the second arm 106 are pulled apart to increase a width of the opening 116 and/or provide additional functions as discussed below. Additional seams 122, 124 may be provided between the perimeter band 110 and the first panel 102A of the fabric shell 102 and between the perimeter band and the second panel 102B of the fabric shell. These seams 122, 124 couple the perimeter band 110 to the fabric shell 102 and further reduce the possibility of the perimeter band and fabric shell tearing when the first arm 104 and the second arm are pulled away from each other. Other seams may be provided in the perimeter band 110, as necessary, to facilitate flexibility of the first and second arms, or to prevent tearing, wherein such seams, for instance, may extend transversely to the perimeter band 110.

The support pillow 100 may include an asymmetric configuration on opposing sides of a laterally-extending plane extending between the first and second support surfaces 112, 114. The asymmetric configuration may provide the support pillow with increased functionality. In particular, the first support surface 112 may define a lofted, arcuate, or otherwise rounded configuration, and the opposing second support surface 114 may define a substantially flat, planar configuration, as illustrated in FIG. 2. In this regard, in order to achieve the lofted configuration, the first panel 102A of the fabric shell 102 may define one or more larger dimensions relative to the second panel 102B of the fabric shell.

Further, in addition to the larger dimension first panel 102A, or in instances where the first and second panels 102A, 102B have the same or substantially similar dimensions, the resilient fill material may be sized and shaped to produce the lofted configuration at the side corresponding to the first support surface 112, and the resilient fill material may be sized and shaped to form a substantially planar configuration at the side corresponding to the opposing second support surface 114. That is, the surface of the resilient fill material disposed directly adjacent the first panel 102A of the fabric shell 102 may be configured to be lofted and generally rounded or arcuate. The surface of the resilient fill material disposed directly adjacent the second panel 102B of the fabric shell 102 may be configured such that it is generally flat. Thus, in one embodiment the resilient fill material may define a shape substantially similar to the ultimate shape of the support pillow 100 prior to being enclosed by the fabric shell 102.

However, in another embodiment the fabric shell 102 may be partially assembled with an aperture left open and configured to receive a loose fill material (e.g., feathers, cotton, etc. to form the lofted support surface) and/or a solid fill material (e.g., a solid foam material to form the substantially planar support surface). In instances where two or more different fill materials are implemented, such different fill materials may be separated, for example, by a fabric panel between each type of fill material, or separate compartments may be formed in the fabric shell 102 for receiving the different types of fill material. That is, in some aspects, the resilient fill material comprises a plurality of fill material components, with adjacent fill material components being separated by a fabric panel extending therebetween, and with the fabric panel being engaged with the fabric shell to prevent intermingling of the adjacent fill material components. For example, in one embodiment, two different fill material components may be implemented as the resilient fill material, and the fabric panel may be engaged with the inside surface of the fabric shell so as to extend in a lateral (i.e., substantially horizontal) plane to separate the two different fill material components from each other. In other aspects, particular types of fill material may be attached to the inside surface of the fabric shell 102 (i.e., a solid foam material may be glued to an appropriate inside surface of the fabric shell 102). Accordingly, such various types or forms of fill material may be used, either separately or in combination, to fill the fabric shell and cause the support pillow to expand to the dimensions allowed by the partially assembled fabric shell (i.e., the first panel 102A having a larger dimension than the second panel 102B). Accordingly, in some embodiments the shape of the support pillow 100 may be defined by one or both of the resilient fill material and the fabric shell 102.

Additionally, the shape of the support pillow 100 may be defined in part by the perimeter band 110. In this regard, the perimeter band 110 may provide structure to the support pillow and allow for a gradual transition between the perimeter band 110 and the first support surface 112 (having the lofted configuration) at the seam 122 and allow for a sharp transition between the perimeter band 110 and the opposing second support surface 114 at the seam 124. In this regard, the perimeter band 110 may be generally perpendicular to the opposing second support surface 114 and extend generally vertically when the opposing second support surface is configured in a horizontal orientation, for example, during use of the support pillow.

In some instances, the dissimilar dimensions of the first support surface 112 and the opposing support surface 114 result in an asymmetrical cross-section, which may allow for greater flexibility in how the pillow is used. In this regard, as noted above, the support pillow 100 may be configured to support an infant. The asymmetric configuration provides the opportunity to employ the first support surface 112 of the support pillow 100 with the lofted configuration to prop up an infant either on his or her back, side, or belly such that the infant may rest comfortably on the first support surface and, in some embodiments, partially within the well 118. Further, the opposing second support surface 114 with the flat, substantially planar configuration may be employed to support an infant during nursing, when the first and second arms are wrapped around a user's torso such that the user's torso is disposed in the well 118. Accordingly, the first support surface 112 and the opposing second support surface 114 may define differing configurations (e.g., lofted, and substantially planar, respectively) in order to provide the support pillow 100 with enhanced performance in the form of multiple modes of functionality depending on which support surface 112, 114 is employed to support the infant.

As illustrated in FIG. 3, in some embodiments the support pillow 100 may further comprise or define a pocket 126. The pocket 126 may be defined in the medial region 108 of the support pillow 100 in some embodiments. However, in other embodiments the pocket 126 may be defined in a different portion of the support pillow 100, such as the first arm 104 or the second arm 106. The pocket 126 may include a fabric liner 128 that defines the pocket and separates the pocket from the resilient fill material. The liner 128 may be sewn or otherwise attached directly to the outer periphery of the support pillow 100. In other aspects, the resilient fill material itself may define the pocket 126. The pocket 126 may extend into the support pillow 100 (e.g., into the medial region 108, the first arm 104, and/or the second arm 106) substantially parallel to the second support surface 114. In some instances, the opening into the pocket 126 may extend along a perimetric seam 120, 122, 124 associated with the perimeter band 110. In such instances, the pocket 126 formed in conjunction with the seam 120, 122, 124 may facilitate attachment of the fabric liner 128 of the pocket 126 and/or reduce the visibility of the opening into the pocket 126. Further, one or more transverse seams 129A, 129B may be provided proximate the pocket 126. The transverse seams 129A, 129B may be configured to prevent tearing (e.g., tearing of the perimeter band 110) proximate the pocket 126. In one embodiment the transverse seams 129A, 129B may align with the center of the pocket 126 across the width thereof, and a medial perimetric seam 120 may align with a center of the pocket across a height thereof.

The pocket 126 may be configured to receive an accessory device intended to enhance comfort of the infant and/or the user wearing the support pillow 100 about his or her torso and/or configured to perform other functions. For example, the pocket 126 may be used as a storage compartment for storing a pacifier, blanket, toy, etc. In this regard, the pocket 126 may be configured to receive, for example, a mechanized or other vibration unit configured to produce soothing vibrations, a sound device configured to produce music and/or or peaceful or familiar sounds configured to soothe and induce sleep in infants, a combination device including a mechanized or other (i.e., electrically-driven) vibration unit and a sound device, a heating or cooling device and/or other accessory device. The vibration unit may comprise a battery-operated motor housed within a protective shell, wherein the shell may include a manually depressible activator or actuator or any other suitable switch or actuator, such as a lever switch or a motion switch/actuator. When the pocket 126 is open, the user may activate the accessory device while it is disposed within the pocket by reaching his or her hand inside the pocket and manually depressing the actuator or actuating the switch. In an alternate embodiment, the user may activate the accessory device by applying pressure to the support pillow 100 about the location of the pocket 126 to depress the actuator or actuate the switch, without reaching inside the pocket. In some embodiments a closure may be included at the opening of the pocket 126, such as a zipper, hook and loop fastener, or other device configured to releasably hold the pocket shut.

As noted above, in some embodiments the support pillow 100 may be configured to receive the torso of a user in the well 118. In this regard, as further noted above, the user may spread the first arm 104 and the second arm 106 apart to form or increase the width of the opening 116 between the first arm and the second arm so that the user's torso may be received therein. In order to facilitate bending of the first arm 104 and the second arm 106, the first arm may include a first laterally-extending indentation 130A, and the second arm may include a second laterally-extending indentation 130B, wherein each indentation 130A, 130B may be defined through interaction between appropriately-configured first and second panels 102A, 102B and the perimeter band 110, as illustrated in FIG. 4. The indentations 130A, 130B may locally reduce cross-sectional areas of the first arm 104 and the second arm 106, along a plane extending perpendicularly to the second panel 102B, such that the first arm and the second arm are easier to bend or deform at the indentations (i.e., form "living hinges") and use of the support pillow 100 may be facilitated by allowing the space between the first and second arms 104, 106 to be more readily increased to facilitate entry into/exit from the well 118 through the opening 116.

FIGS. 5-7 illustrate alternate embodiments of the support pillow. The embodiments of the support pillows illustrated in FIGS. 5-7 may be substantially similar to the embodiment of the support pillow 100 illustrated in FIGS. 1-4, with the exception of the differences described below. In this regard, elements in FIGS. 5-7 corresponding to those included in the first embodiment of the support pillow 100 are shown with a reference numeral that is the same as those appearing in FIGS. 1-4 with the exception of the first digit, which is incremented based on the embodiment.

FIGS. 5 and 6 illustrate a support pillow 200 according to a second embodiment. The support pillow 200 may include a cover 232 that substantially entirely surrounds, collectively, the first arm 204, the second arm 206, and the medial region 208 of the support pillow defined by the fabric shell and resilient fill material, as discussed above. As illustrated, in some embodiments the cover 232 may include a first panel 234 at the first support surface 212, a second panel 236 at the opposing second support surface 214, and a perimeter band 238 that respectively and substantially correspond in size and shape to the first and second panels of the fabric shell and the perimeter band of the support pillow 200. The cover 232 (and/or the fabric shell) may be produced from materials that are water resistant, stain resistant, machine washable, and/or waterproof in some embodiments, although various other materials and fabrics (i.e., textured materials, fireproof materials, or the like) may be employed in other embodiments.

In some embodiments the cover 232 may be permanently affixed to the fabric shell of the support pillow 200. However, in other embodiments the cover may be selectively removable and/or machine washable. In this regard, FIG. 6 illustrates a closure 240 in the form of a zipper that is configured to open and close to allow the cover 232 to releasably secure the filled fabric shell therein. Various other embodiments of closures may be employed to releasably secure the cover 232 in a closed configuration, such as hook and look fasteners, snap fasteners, buttons, etc. The closure 240 may extend around all or a portion of the perimeter of the support pillow 200 in some embodiments. The closure 240 may be configured to provide access to the pocket 226 defined in the support pillow 200, or a separate closure and/or opening may be provided to enable access to the pocket. In this regard, the support pillow 200 may define a resealable opening (at the closure 240, or a separate closure) that is configured to align with the pocket 226 defined in the medial region 208.

The cover 232 may include a handle 242, though such a handle may be included in addition to or instead of a similar handle on the fabric shell of the support pillow (i.e., in some embodiments, not including a cover 232, the fabric shell of the support pillow itself may include such a handle). As such, aspects herein involving a handle 232 may also be applicable to the fabric shell of the support pillow in instances where a cover 232 is not provided. The handle 242 may be useable to carry the support pillow 200. As illustrated in FIG. 6, in some embodiments the handle 242 may extend along and/or across the pocket 226 at the perimeter of the support pillow 200. Further, in some embodiments the handle 242 may define one or more loops 244A-D, in cooperation with the cover 232 (i.e., through spaced-apart seams securing the handle member to the cover 232). The loops 244A-D, which may be positioned at opposing ends of the handle 242, may be configured to attach one or more components or peripheral accessories to the cover 232 of the support pillow 200, such as, for example, child's toys.

FIG. 7 illustrates an additional embodiment of the support pillow 300. The support pillow 300 may comprise an adjustment mechanism 346 configured to adjust at least one of a width of the opening 316 defined between the first arm 304 and the second arm 306 and an area of the open well 318. The adjustment mechanism 346 may comprise an elongated flexible member 348 extending from the first arm 304 around the well 318 to the second arm 306 and a fixation member 350 coupled to one or both of the first arm and the second arm and configured to releasably engage the elongated flexible member at a user-selectable position. In one embodiment one of the elongated flexible member 348 and the fixation member 350 comprises a hook material, and the other of the adjustable elongated member and the fixation member comprises a loop material. However, in other embodiments, buttons, clips, snap fasteners, cords and clasps and/or other mechanisms may be employed to define the adjustment mechanism 346.

Further, the elongated flexible member 348 may define an exposed section disposed at one or both of the first arm 304 and the second arm 306 and an internal section disposed inside the fabric shell 302 and partially surrounding the well 318. In this regard, the elongated flexible member 348 may extend substantially parallel and adjacent to the perimeter band 310 on inside surfaces (at the internal section of the elongated flexible member) and outside surfaces (at the exposed section(s) of the elongated flexible member) thereof. The adjustment mechanism 346 may be configured to decrease the area of the well 318 and the width of the opening 316 between the first arm 304 and the second arm 306 when a length of the exposed section of the elongated flexible member 348 is increased relative to a length of the internal section of the elongated flexible member. In this regard, a user may detach the elongated flexible member 348 from the fixation member 350 at one of the arms 304, 306, pull on the elongated flexible member so as to increase the length of the exposed portion of the elongated flexible member, and reattach the elongated flexible member to the fixation member. This process may be repeated for the other of the arms 304, 306 in embodiments of the support pillow 300 employing elongated flexible members 348 that are detachable at both of the ends thereof. When an end of the elongated flexible member 348 is pulled, a compressive force applied by the elongated flexible member to the resilient fill material causes a reduction in the width of the opening 316 between the first arm 304 and the second arm 306 as well as the area of the well 318. When one or more ends of the elongated flexible member 348 are released from the fixation member 350 after the elongated flexible material has been placed in tension, the resilient fill material expands from the compressive state allowing the support pillow 300 to return to its original shape.

As further illustrated in FIG. 7, in some embodiments the support pillow may further comprise one or more additional transverse seams 352A, 352B. These transverse seams 352A, 352B may be positioned on the perimeter band 310 across from, and centered with, the opening 316 between the first arm 304 and the second arm 306 in some embodiments. In this regard, the transverse seams 352A, 352B may be oriented perpendicularly to the perimeter band 310 at one or more locations around the well 318 where stress may concentrate when the first arm 304 and the second arm 306 are pulled apart. Accordingly, the transverse seams 352A, 352B may be configured to withstand the forces (e.g., tensile forces) applied thereto during movement of the first arm 304 and the second arm 306 apart from one another.

In an additional embodiment a method for forming a support pillow, such as the support pillows 100, 200, 300 described above, is provided. The method may include providing a resilient fill material and a fabric shell comprising a first panel and a second panel, and coupling the first panel of the fabric shell to the second panel of the fabric shell with the fill material therebetween so as to at least partially enclose the fill material with the fabric shell and define a support pillow comprising a first arm, a second arm, and a medial region that connects the first arm to the second arm. The first arm, the second arm, and the medial region may partially or substantially surround and define a well, wherein the first arm and the second arm may be configured to be separable to provide a user with access to the well therebetween, or wherein the first arm and second arm may define an opening therebetween to provide access to the well. Further, the first arm, the second arm, and the medial region may define a first support surface with a lofted configuration and an opposing second support surface with a substantially planar configuration.

In some embodiments the method may further comprise coupling a perimeter band to the first panel of the fabric shell and to the second panel of the fabric shell such that the perimeter band extends around the perimeter of the support pillow between the first support surface and the opposing second support surface. Also, the method may include coupling an adjustment mechanism to the support pillow, wherein the adjustment mechanism is configured to adjust at least one of a width of the opening between the first arm and the second arm and an area of the well. Coupling the adjustment mechanism to the support pillow may comprise enclosing an internal section of an elongated flexible member between the first panel and the second panel of the fabric shell so as to partially surround the well, and releasably coupling an exposed section of the elongated flexible member to one of the first arm and the second arm.

Many modifications and other embodiments of the disclosure set forth herein will come to mind to one skilled in the art to which the disclosure pertains having the benefit of the teachings presented in the foregoing descriptions. Therefore, it is to be understood that the disclosure is not to be limited to the specific embodiments described herein and that modifications and other embodiments are intended to be included within the scope of the appended claims. Although specific terms are employed herein, they are used in a generic and descriptive sense only and not for purposes of limitation.

The invention claimed is:

1. A support pillow, comprising:

a resilient fill material; and a fabric shell at least partially enclosing the fill material, wherein the resilient fill material and the fabric shell define a first arm, a second arm, and a medial region that connects the first arm to the second arm, wherein the first arm, the second arm, and the medial region at least partially surround and collectively define a well;

wherein the first arm, the second arm, and the medial region define a first laterally-extending support surface with a continuously arcuate and convex configuration and an opposing second laterally-extending support surface with a substantially planar configuration, the medial region having a greater lateral cross-sectional area than a lateral cross-sectional area of each of the first arm and the second arm.

2. The support pillow of claim 1, wherein the first arm and the second arm are configured to be separable to provide a user with lateral access to the well, the well being sized and adapted to receive a torso of the user therein.

3. The support pillow of claim 1, further comprising a perimeter band, wherein the fabric shell comprises a first fabric panel defining the first laterally-extending support surface and a second fabric panel defining the opposing second laterally-extending support surface, and wherein the perimeter band is affixed to the first fabric panel at the first laterally-extending support surface and affixed to the second fabric panel at the second laterally-extending support surface, the perimeter band extending around the entire perimeter of the first arm, second arm, and the medial region, between the first laterally-extending support surface and the opposing second laterally-extending support surface, the perimeter band cooperating with the first fabric panel and the second fabric panel to enclose the resilient fill material.

4. The support pillow of claim 3, further comprising a pocket extending into a respective one of the medial region, the first arm, and the second arm, at least one of substantially parallel to the second laterally-extending support surface and along a seam extending around the perimeter band.

5. The support pillow of claim 3, further comprising a seam extending transverse to a longitudinal length of the perimeter band and proximate to the well.

6. The support pillow of claim 3, wherein the resilient fill material comprises a plurality of fill material components, with adjacent fill material components being separated by a third fabric panel extending therebetween, the third fabric panel being engaged with at least one of the first fabric panel and the second fabric panel to prevent intermingling of the adjacent fill material components.

7. The support pillow of claim 1, further comprising a pocket defined in one of the medial region, the first arm, and the second arm.

8. The support pillow of claim 7, wherein a fabric liner defines the pocket and separates the pocket from the resilient fill material.

9. The support pillow of claim 7, wherein the resilient fill material defines the pocket.

10. The support pillow of claim 1, wherein the resilient fill material comprises at least one of a loose fill material component and a solid fill material component.

11. The support pillow of claim 1, wherein a width of the first arm between an inner periphery proximate the well and an outer periphery oppositely disposed with respect thereto varies along a length of the first arm and a width of the second arm between the inner periphery and the outer periphery varies along a length of the second arm.

12. The support pillow of claim 1, further comprising a cover configured to substantially and collectively enclose the first arm, the second arm, and the medial region.

13. The support pillow of claim 12, wherein at least one of the cover and the fabric shell comprises a handle.

14. The support pillow of claim 13, wherein the handle defines one or more loops configured to attach one or more peripheral components.

15. The support pillow of claim 12, wherein the cover defines a resealable opening configured to align with a pocket defined in the medial region.

16. The support pillow of claim 1, further comprising an adjustment mechanism configured to adjust at least one of a width of the opening between the first arm and the second arm and an area of the well.

17. The support pillow of claim 16, wherein the adjustment mechanism comprises an elongated flexible member extending from the first arm around the well to the second arm and a fixation member coupled to one of the first arm and the second arm and configured to releasably engage the elongated flexible member at a user-selectable position.

18. The support pillow of claim 17, wherein one of the elongated flexible member and the fixation member comprises a hook material, and the other of the adjustable elongated member and the fixation member comprises a loop material.

19. The support pillow of claim 17, wherein the elongated flexible member defines an exposed section disposed at one of the first arm and the second arm and an internal section disposed inside the fabric shell and partially surrounding the well, and wherein the adjustment mechanism is configured to decrease the area of the well and the width of the opening between the first arm and the second arm when a length of the exposed section of the elongated flexible member is increased relative to a length of the internal section of the elongated flexible member.

20. The support pillow of claim 1, wherein the first arm comprises a first indentation and the second arm comprises a second indentation respectively defined at an outer portion thereof distal from the well, the first indentation being oppositely disposed with respect to a first concave portion of the first arm proximate the well, the second indentation being oppositely disposed with respect to a second concave portion of the second arm proximate the well, wherein the first indentation and the second indentation are respectively configured to cooperate with one of the first concave portion and the second concave portion to facilitate bending of the first arm and the second arm.

21. The support pillow of claim 1, wherein a maximum height of the medial region is greater than a maximum height of the first arm and the second arm.

22. The support pillow of claim 21, wherein a maximum width of the medial region between an inner periphery and an outer periphery is greater than a maximum width of the first arm between the inner periphery and the outer periphery and greater than a maximum width of the second arm between the inner periphery and the outer periphery.

23. The support pillow of claim 22, wherein a volume of the medial region is greater than a volume of the first arm and the volume of the medial region is greater than the volume of the second arm.

24. A support pillow, comprising:

a resilient fill material; and a fabric shell at least partially enclosing the fill material, wherein the resilient fill material and the fabric shell define a first arm, a second arm, and a medial region that connects the first arm to the second arm, wherein the first arm, the second arm, and the medial region at least partially surround and collectively define a well;

wherein an outer portion of the first arm distal from the well comprises a first indentation and an outer portion of the second arm distal from the well comprises a second indentation, the first indentation being oppositely disposed with respect to a first concave portion of the first arm proximate the well, the second indentation being oppositely disposed with respect to a second concave portion of the second arm proximate the well, wherein the first indentation and the second indentation are respectively configured to cooperate with one of the first concave portion and the second concave portion to facilitate bending of the first arm and the second arm.

25. The support pillow of claim 24, further comprising a perimeter band, wherein the fabric shell comprises a first fabric panel defining a first laterally-extending support surface with a continuously arcuate and convex configuration and a second fabric panel defining an opposing second laterally-extending support surface with a substantially planar configuration, wherein the perimeter band is affixed to the first fabric panel at the first laterally-extending support surface and affixed to the second fabric panel at the second laterally-extending support surface, the perimeter band extending around the entire perimeter of the first arm, second arm, and the medial region, between the first laterally-extending support surface and the opposing second laterally-extending support surface, the perimeter band cooperating with the first fabric panel and the second fabric panel to enclose the resilient fill material, and wherein the first indentation and the second indentation are respectively defined by the first fabric panel, the second fabric panel, and the perimeter band.

26. A method for forming a support pillow, the method comprising:

providing a resilient fill material and a fabric shell comprising a first panel and a second panel;

coupling the first panel of the fabric shell to the second panel of the fabric shell with the fill material therebetween so as to at least partially enclose the fill material with the fabric shell and define a support pillow comprising a first arm, a second arm, and a medial region that connects the first arm to the second arm, wherein the first arm, the second arm, and the medial region at least partially surround and collectively define a well, the first arm and the second arm being configured to be separable to provide a user with access to the well and adapted and sized to wrap around a torso of the user when received therein;

wherein the first arm, the second arm, and the medial region define a first support surface with a continuously arcuate and convex configuration and an opposing second support surface with a substantially planar configuration, the medial region having a greater lateral cross-sectional area than a lateral cross-sectional area of each of the first arm and the second arm.

27. The method of claim 26, further comprising coupling a perimeter band to the first panel of the fabric shell at the first support surface and to the second panel of the fabric shell at the second opposing support surface such that the perimeter band extends around the entire perimeter of the support pillow between the first support surface and the opposing second support surface, the perimeter band cooperating with the first panel and the second panel of the fabric shell to enclose the resilient fill material.

28. The method of claim 26, further comprising coupling an adjustment mechanism to the support pillow, wherein the adjustment mechanism is configured to adjust at least one of a width of the opening between the first arm and the second arm and an area of the well.

29. The method of claim 28, wherein coupling the adjustment mechanism to the support pillow comprises enclosing an internal section of an elongated flexible member between the first panel and the second panel of the fabric shell so as to partially surround the well; and releasably coupling an exposed section of the elongated flexible member to one of the first arm and the second arm.

* * * * *